US008479333B2

(12) United States Patent
Gould et al.

(10) Patent No.: US 8,479,333 B2
(45) Date of Patent: Jul. 9, 2013

(54) FOOT/LEG CRADLE CUSHION FOR CARDIO CIRCULATION ENHANCEMENT

(76) Inventors: Edward S. Gould, Dix Hills, NY (US); Peter Georgatos, Bohemia, NY (US)

( * ) Notice: Subject to any disclaimer, the term of this patent is extended or adjusted under 35 U.S.C. 154(b) by 172 days.

(21) Appl. No.: 12/928,488

(22) Filed: Dec. 13, 2010

(65) Prior Publication Data

US 2011/0179577 A1 Jul. 28, 2011

Related U.S. Application Data

(60) Provisional application No. 61/336,424, filed on Jan. 22, 2010.

(51) Int. Cl.
*A61G 13/12* (2006.01)

(52) U.S. Cl.
USPC ..... 5/648; 5/624; 5/655.9

(58) Field of Classification Search
USPC ..... 5/648, 624, 655.9
See application file for complete search history.

(56) References Cited

U.S. PATENT DOCUMENTS 3,712,271 A 1/1973 Greathouse
4,433,682 A 2/1984 Badra
4,926,884 A 5/1990 Lonardo
5,362,305 A 11/1994 Varn
5,745,939 A * 5/1998 Flick et al. ..... 5/648
6,260,221 B1 * 7/2001 Grabell et al. ..... 5/648
6,564,407 B1 * 5/2003 Luu et al. ..... 5/648
7,426,764 B2 9/2008 Ekins
2008/0178390 A1 * 7/2008 DuDonis ..... 5/648

* cited by examiner

*Primary Examiner* — Robert G Santos
*Assistant Examiner* — Brittany Wilson
(74) *Attorney, Agent, or Firm* — Alfred M. Walker

(57) ABSTRACT

A foot/leg cradle cushion prevents crossing of ankles or legs for long periods of time, which has been associated with circulatory problems related to cardiac or stroke episodes. The cradle cushion is a soft yet sufficiently supportive device whereby the feet and/or lower legs are held separated from each other and prevented from being crossed. The cradle cushion has a pair of outer flange walls extending upward from a base with a taller middle wall that separates the feet or lower legs of the user. Thus is formed a U-shaped recess on either side of the central wall which would receive each foot and/or leg separated by the width of the central wall. This effectively prevents leg crossing which causes compression of the user's circulatory system in both lower legs and ankle regions.

15 Claims, 3 Drawing Sheets

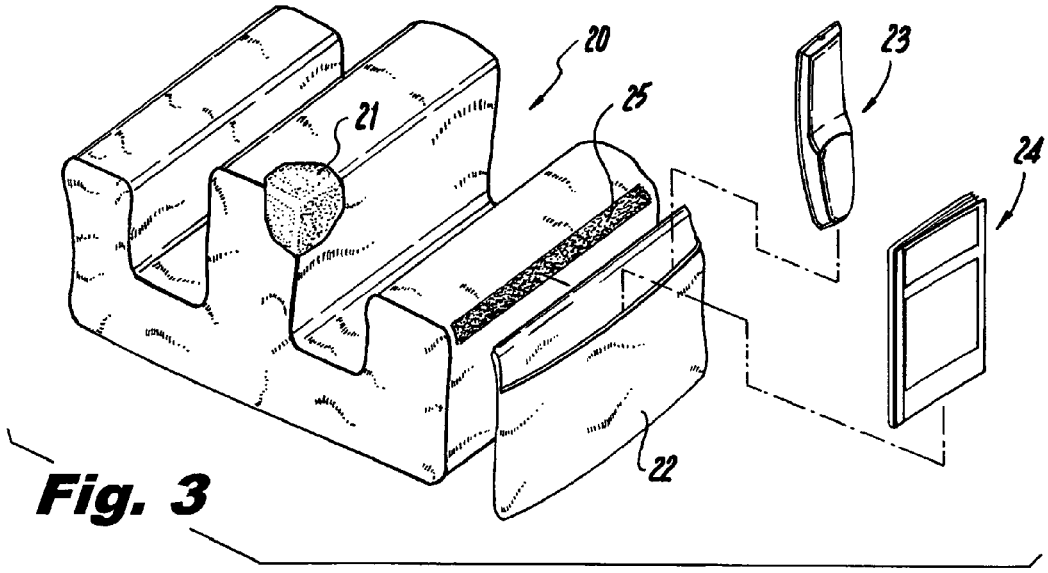
Fig. 3
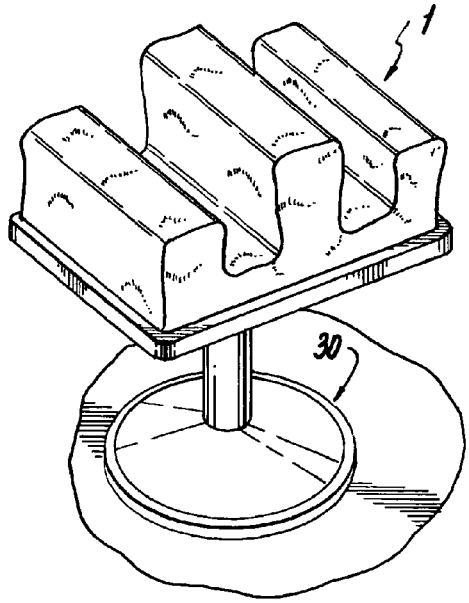
Fig. 4
Fig. 5
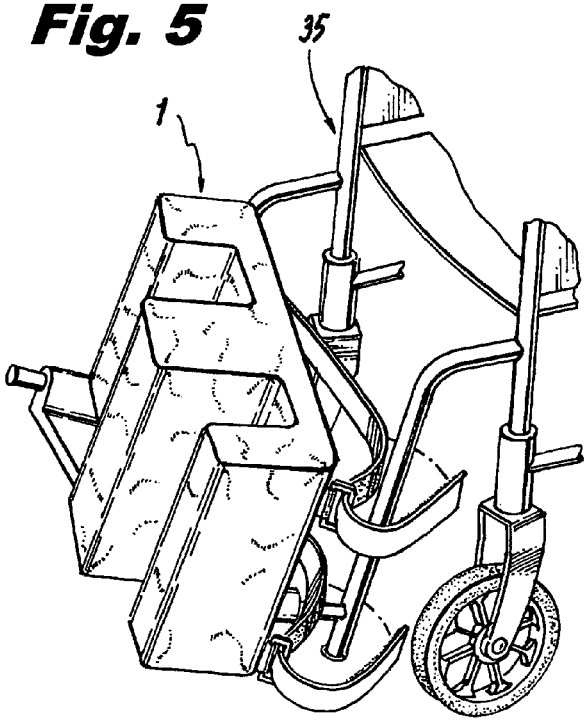

Fig. 6
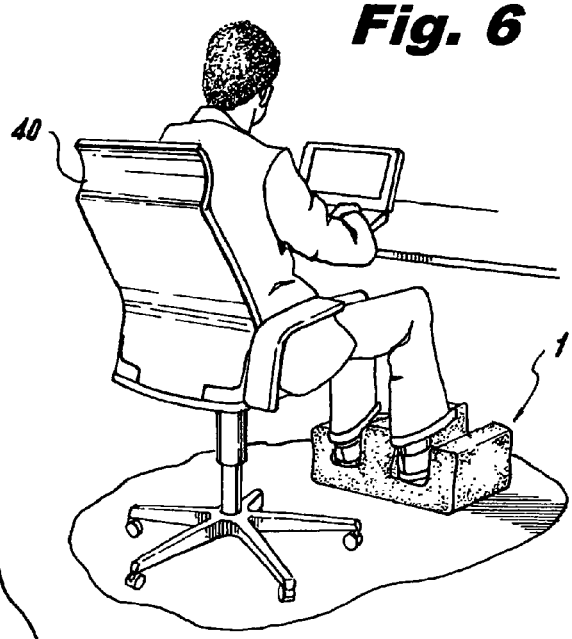
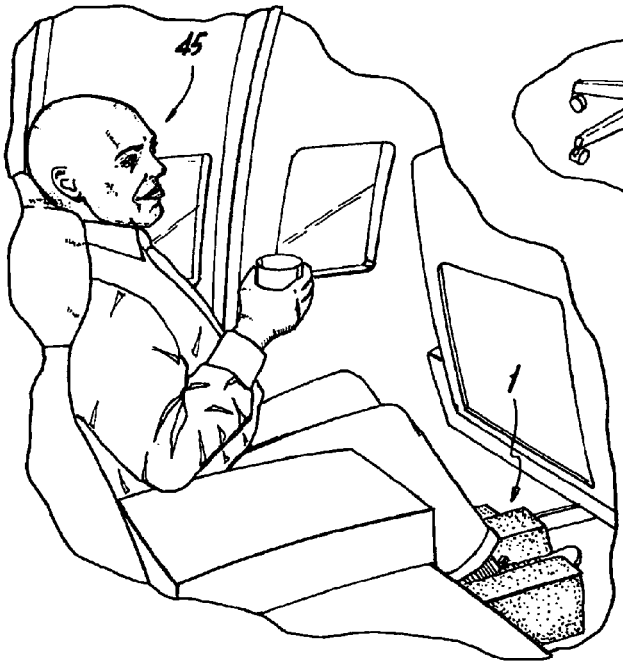
Fig. 7
Fig. 8
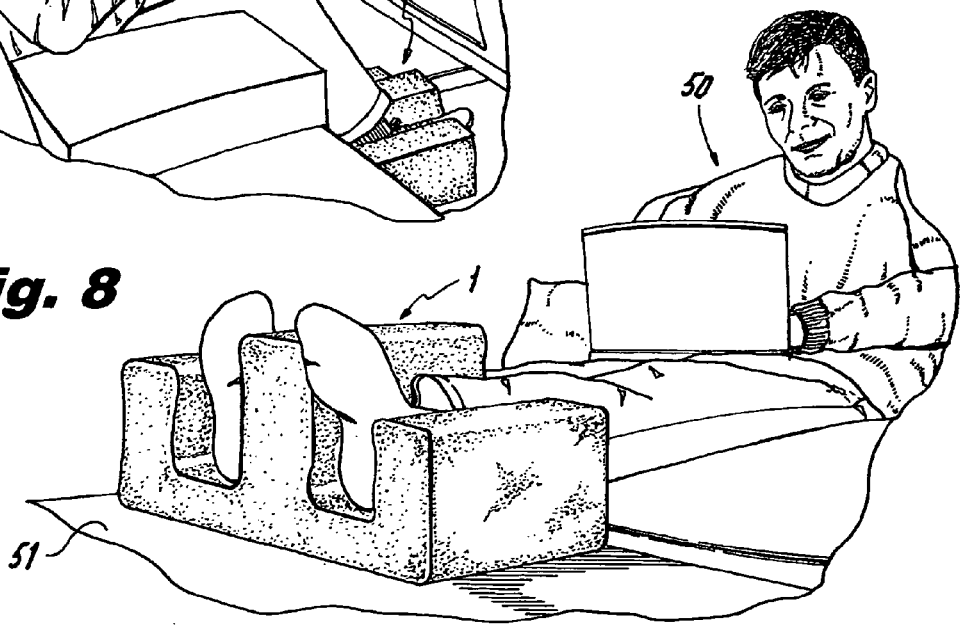

FOOT/LEG CRADLE CUSHION FOR CARDIO CIRCULATION ENHANCEMENT

RELATED APPLICATIONS

This application claims priority and benefit under 35 U.S.C. 119(e) from provisional Application No. 61/336,424 filed Jan. 22, 2010, the entire disclosure of which is incorporated by reference herein.

FIELD OF THE INVENTION

The present invention relates to a foot/leg cradle cushion to enhance cardio-circulation in the legs of a resting person.

BACKGROUND OF THE INVENTION

One of the co-applicants herein is a survivor of a major heart attack. Multiple stents as well as a double by-pass were used to treat the heart attack. Every day in the hospital for these procedures and recovery, it was pointed out that crossing the legs, particularly at the ankles, restricts circulation of blood to the feet thereby constituting a major factor in the formation of blood clots in the feet. For this reason there are often signs in hospital rooms (especially with television sets) warning patients not to cross their legs and prop them up on the foot of the bed or other hard edge.

The prior art does address the problem of restricting circulation of blood to the feet and/or crossing one's legs for other health reasons. Bada's Ankle Protector of U.S. Pat. No. 4,433,682 consists of a pair of foam pads with straps. Each pad is wrapped around the ankle and calf of each leg to keep the ankle cushioned when crossed upon the other similarly wrapped leg; then the straps are also used to attach one pad to the other thereby permitting the legs to be crossed without the danger of restricting circulation to the feet. However this is not comfortable to many users since the legs are attached to each other and are restricted from moving independently until the straps are disengaged from one pad to the other. Inventor Ekins in U.S. Pat. No. 7,426,764 shows a circulation enhancing sleeve in the form of a strap with a small cushion which can be wrapped around the ankle of one leg so that it can safely be crossed on the other leg without restricting blood circulation to the feet. The user must be able to bend sufficiently to wrap sleeve cushion or to unwrap it from the ankle.

Other prior art is targeted to devices which prevent actual crossing of the legs. Lonardo in his U.S. Pat. No. 4,926,884 presents an apparatus and method for preventing skin abrasions when legs substantially locked in juxtaposition. While the long cushioned pad is attached with straps to the side of one leg for bedridden patients suffering from valgus, it could be used by the general population to effectively prevent crossing one's legs. This is not a comfortable ergonomic solution however.

Varn, in his hip and knee abductor of U.S. Pat. No. 5,362,305, describes another apparatus that effectively prevents crossing one's legs although its use is primarily to correct some types of congenital hip defects or hip dislocations. It incorporates a pair of thigh cuffs attached to each other by a rigid adjustable bar. This is hardly a comfortable alternative to the solution for preventing foot circulation problems of the instant invention.

The prior art does not reveal a comfortable inexpensive cushion designed to prevent foot circulation problems in a non constricting manner.

OBJECTS OF THE INVENTION

An object of this invention is to provide a cradle cushion that can be moved up and down the legs while passively discouraging crossing of the legs.

Another object of this invention is to permit a seated person to simply cradle his or her feet in the cushion of this invention passively preventing ankles from being crossed.

A further object of this invention is to provide a comfortable footrest on any coffee table without the fear of causing scratches as from shoes.

Yet another object of this invention is to provide a cradle cushion that is collapsible and inflatable to enhance its portability.

A further object of this invention is to simultaneously raise legs and discourage crossing legs in a comfortable manner without undue restriction.

Another object of this invention is to provide a cradle cushion providing the above objects without the use of straps or hooks which may be difficult to apply or remove therefore presenting a tripping hazard.

SUMMARY OF THE INVENTION

For reasons described above, it has been established that for preventing circulatory problems related to cardiac or stroke episodes it is desirable to prevent crossing of ankles or legs for long periods of time. The foot/leg cradle cushion of this invention is an effective means to this end. The cradle cushion of this invention is a purposely shaped soft yet sufficiently supportive device whereby the feet and/or lower legs are held separated from each other and prevented from being crossed. The cradle cushion has a pair of outer flange walls extending upward from a base with a taller middle wall that separates the feet or lower legs of the user. Preferably, the middle wall is taller than the outer flange walls. Thus is formed a U-shaped recess on either side of the central wall which would receive each foot and/or leg separated by the width of the central wall. This effectively prevents compression of the user's circulatory system in both lower legs and ankle regions.

In the preferred embodiment, the cradle cushion is fabricated as an inflatable device preferably using an inflatable material, such as a thermally or ultrasonically bonded vinyl (PVC) or other synthetic material with a bonded outer surface, such as a soft velvet surface or flocking. As an inflatable object, the rigidity (hardness or softness) of the cradle cushion can be regulated by the internal pressure used during inflating through the attached filling tube. In addition, the cradle cushion of this embodiment can be deflated and collapsed for compact storage or transport.

In an alternate embodiment, the cradle cushion of this invention can be fabricated of a compressible material, such as semi-soft foam sections adhesively bonded or just cut to shape from a block. A polyurethane or other foam may be used. An appropriately soft fabric cover is preferably used over the foam interior.

Alternatively, the cradle cushion can be an outer cover bag container filled with a collection of loose, small, smooth pellets, such as natural hulls, seeds, beans or individual fibers, or synthetic pellets of plastic, foam or other smooth units. The outer cover can have a soft exterior surface, or it can be itself covered by a further outer cover of an appropriately soft fabric material made of natural or synthetic fibers.

The cradle cushion of this invention may be used in a wide variety of venues since it can support the feet from the back and side of the heel as well as the bottom, and the lower legs can be supported from the back of the calf. Therefore the cradle cushion is useful while lying on one's back, while seated with legs down, or while seated with legs propped on a footrest or on a coffee table (where it would also prevent scratching).

BRIEF DESCRIPTION OF THE DRAWINGS

The present invention can best be understood in connection with the accompanying drawings. It is noted that the invention is not limited to the precise embodiments shown in drawings, in which:

FIG. 3 is a perspective view of the alternate embodiment of the cradle cushion using an inner core of semi-soft resilient foam.

FIG. 4 is a perspective view of the cradle cushion supported by a footrest.

FIG. 5 is a perspective detail illustrating the position of a cradle cushion supported by a footrest of a wheelchair in an orientation to engage the lower legs from the back side.

FIG. 6 is a perspective view of a user seated on an office chair using a computer with his feet engaged with a cradle cushion.

FIG. 7 is a perspective view of a person sitting in an airline seat with his feet in the recesses of a cradle cushion.

FIG. 8 is a perspective view of a user sitting on a sofa with his feet supported by a cradle cushion on a coffee table.

DETAILED DESCRIPTION OF THE INVENTION

Figure 1:
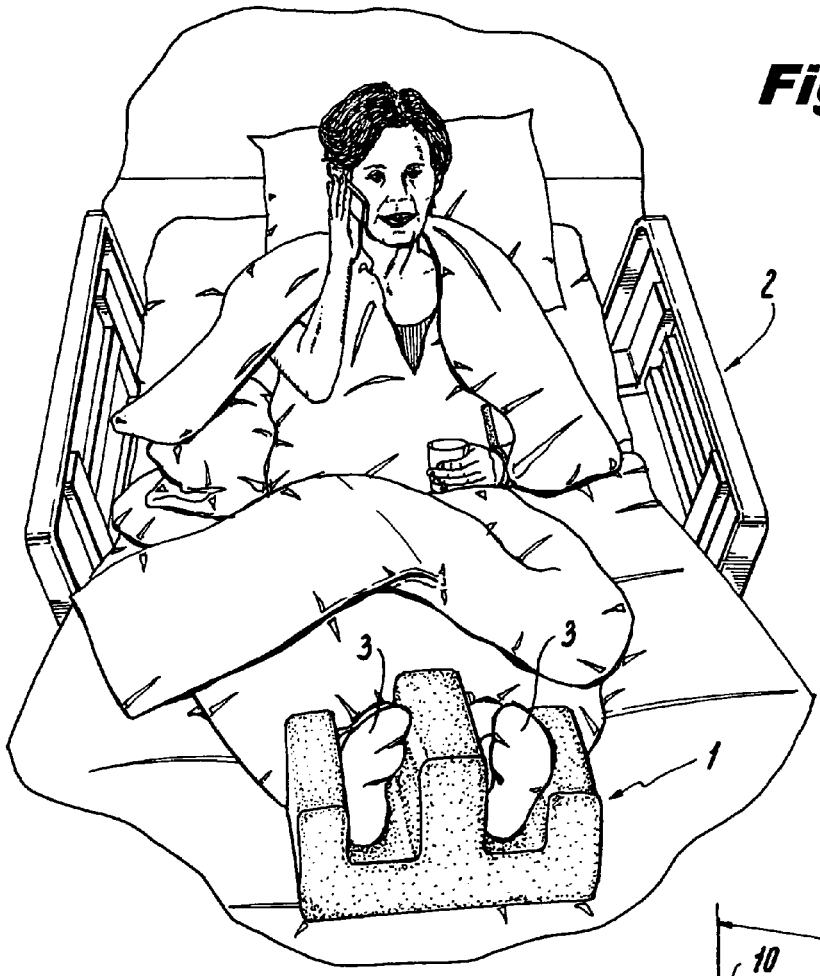
FIG. 1 is a perspective view of a person lying in a hospital bed while using a cradle cushion of this invention.

As can be seen in FIG. 1, a patient in a hospital bed 2 can use the cradle cushion 1 of this invention while lying on her back and inserting her feet 3 in its recesses. This also raises the legs closer to heart level to further enhance circulation.

Figure 2:
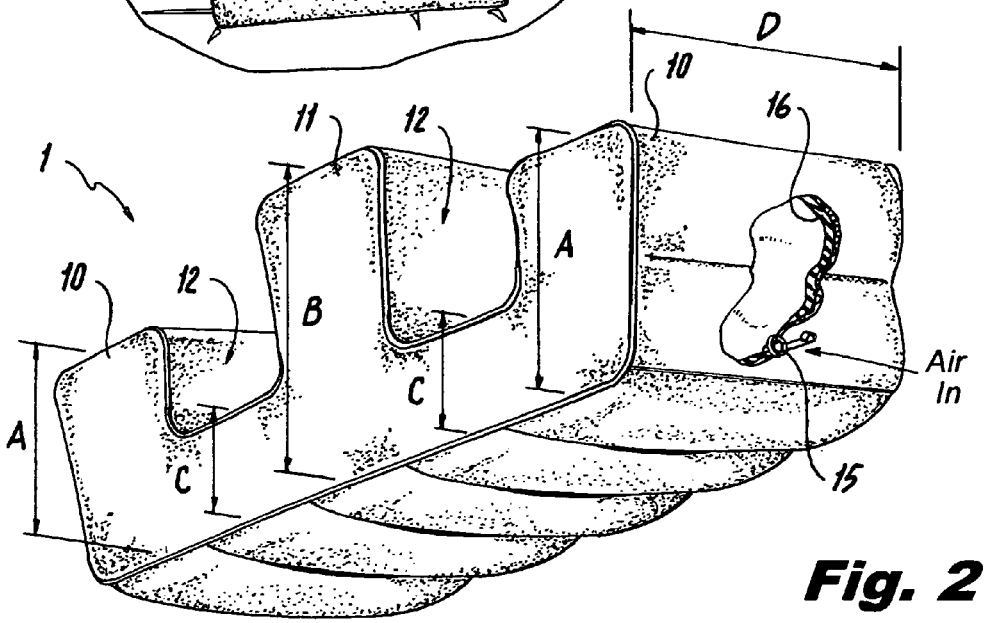
FIG. 2 is perspective view of the cradle cushion showing details of its construction as an inflatable device of the preferred embodiment.

The details of the preferred embodiment of cradle cushion 1 are illustrated in FIG. 2. The left and right outer flange walls 10 are separated from the central wall 11 thus forming two foot/leg recesses 12 whereby the feet or legs are separated apart and prevented from touching (which would tend to restrict circulation to the feet). This embodiment is inflatable with a flexible airtight preferably PVC material 16 with a fabric cover, such as a soft velvet bonded outer layer or flocking. The inflating air enters at filling tube 15 with attached plug. Although sizes may vary, the cradle cushion is approximately 12" deep (dimension "D"). Central wall 11 is 10" tall ("B"), flange walls 10 are 8" tall ("A"), and the elevation at the bottom of recesses 12 is 4" ("C").

FIG. 3 shows the details of an alternate embodiment cradle cushion 20 which has the same shape and dimensions as the cradle cushion of FIG. 2 but is filled with a semi rigid resilient foam 21 covered with an outer fabric. Since it is not inflatable, one cannot adjust the rigidity of cradle cushion 20 by adjusting the internal air pressure. Optional accessory attachable pouch 22 is shown at the side. This can be used to hold a portable phone 23 or notebook 24. It is removably attached to cradle cushion 20 by hook and loop fastener strips as shown at 25. This optional accessory pouch can also be attached to the inflatable cradle cushion 1 of FIG. 2. Alternatively cradle cushion 20 can be an outer cover bag container filled with a collection of loose, small, smooth pellets, such as natural hulls, seeds, beans or individual fibers, or synthetic pellets of plastic, foam or other smooth units. The outer cover 20 can have a soft exterior surface, or it can be itself covered by a further outer cover of an appropriately soft fabric material made of natural or synthetic fibers.

FIG. 4 shows cradle cushion 1 (or 20) atop a footrest 30.

FIG. 5 shows cradle cushion 1 being installed with one open end resting on the footrest of wheelchair 35. It would support and separate the back of each lower leg (ankle and calf) of the user comfortably separating one leg from the other.

FIGS. 6 and 7 show two venues in which cradle cushion 1 is used to support the bottoms of the feet of each user instead of the heel portion. FIG. 6 depicts a person in an office chair 40 working at a computer; FIG. 7 shows a person 45 in an airline seat.

FIG. 8 shows a person 50 sitting on a sofa using cradle cushion 1 on a nearby coffee table 51. The feet are supported from the heel portion and ankle as in the posture of the woman shown in FIG. 1.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A foot/leg cradle cushion for preventing crossed legs and related circulatory problems, comprising:

a) said cushion being inflatable and having a base having a region extending above said base;

b) said base having a pair of outer flange walls extending upward therefrom, and a middle flange extending upward therefrom and extending substantially higher than said outer flange walls;

c) said middle flange separating a region above said base into a pair of adjacent U-shaped walled areas;

d) each said U-shaped walled area adapted to separately holding one of a user's lower legs separate and apart from the user's other lower leg;

e) a filling tube for said inflatable cushion on a side wall of said cushion; and f) thereby preventing compression of the user's circulatory system of blood flow in both of the lower legs and ankle regions of the user's respective legs, and whereby internal pressure of said cushion is regulated, and said cushion deflated for compact storage or transport.

2. The foot/leg cradle cushion of claim 1 wherein said middle flange is about two inches higher than the outer flange walls.

3. The foot/leg cradle cushion as in claim 1 wherein said middle flange is about 10" in height and said outer flanges are about 8" in height.

4. The foot/leg cradle cushion as in claim 1 wherein said inflatable device is a bonded vinyl (PVC) material with a bonded outer soft fabric surface.

5. A foot/leg cradle cushion for preventing crossed legs and related circulatory problems, comprising:

a) a base having a region extending above said base;

b) said base having a pair of outer flange walls extending upward therefrom, and a middle flange extending upward therefrom and extending substantially higher than said outer flange walls;

c) said middle flange separating a region above said base into a pair of adjacent U-shaped walled areas and being substantially higher than said outer flange walls;

d) each said U-shaped walled area adapted to separately holding one of a user's lower legs separate and apart from the user's other lower leg; and, e) thereby preventing compression of the user's circulatory system of blood flow in both of the lower legs and ankle regions of the user's respective legs.

6. The foot/leg cradle cushion as in claim 5 wherein said foot/leg cradle cushion is cushioned.

7. The foot/leg cradle cushion as in claim 6 wherein said foot/leg cradle cushion is fabricated of semi-soft foam.

8. The foot/leg cradle cushion as in claim 7 wherein said foam is polyurethane.

9. The foot/leg cradle cushion as in claim 6 wherein said cradle cushion is an outer cover bag container filled with a collection of loose, small, smooth pellets.

10. The foot/leg cradle cushion as in claim 6 wherein said foot/leg cradle cushion is covered by a fabric cover.

11. A method for preventing crossed legs and related circulatory problems, comprising the steps of:

a) inflating an inflatable cushion having a base with a pair of outer flange walls extending upward therefrom, and a middle flange extending upward therefrom, said middle flange extending substantially higher than said outer flange walls forming a pair of adjacent U-shaped walled areas;

b) using a filling tube on a side wall of said cushion to inflate said cushion to a desired pressure within said cushion whereby internal pressure of said cushion is regulated;

d) separating a patient's lower legs by inserting said legs into said walled areas and raising said legs closer to heart level to enhance circulation thereby preventing compression of the patient's circulatory system of blood flow in both of the lower legs and ankle regions of the user's respective legs; and f) deflating said cushion after use for compact storage or transport.

12. The method of claim 11 wherein the patient is lying flat on a bed.

13. The method of claim 11 wherein the patient is seated upright in a seat.

14. The method of claim 11 wherein the patient is reclined in a seat.

15. A method for preventing crossed legs and related circulatory problems, consisting of the steps of:

a) inflating an inflatable cushion having a base with a pair of outer flange walls extending upward therefrom, and a middle flange extending upward therefrom, said middle flange extending substantially higher than said outer flange walls forming a pair of adjacent U-shaped walled areas;

b) using a filling tube on a side wall of said cushion to inflate said cushion to a desired pressure within said cushion whereby internal pressure of said cushion is regulated;

d) separating a patient's lower legs by inserting said legs into said walled areas and raising said legs closer to heart level to enhance circulation thereby preventing compression of the patient's circulatory system of blood flow in both of the lower legs and ankle regions of the user's respective legs; and f) deflating said cushion after use for compact storage or transport.

* * * * *